US012660970B2

(12) United States Patent
DeBlasio et al.

(10) Patent No.: US 12,660,970 B2
(45) Date of Patent: Jun. 23, 2026

(54) FLOOR CLEANER WITH A LOW POWER MODE

(71) Applicant: Techtronic Cordless GP, Anderson, SC (US)

(72) Inventors: Nicholas DeBlasio, Waxhaw, NC (US); Rafael Davila, Kannapolis, NC (US); Donovan Bode, Charlotte, NC (US); Douglas Rukavina, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 14 days.

(21) Appl. No.: 18/007,437

(22) PCT Filed: Aug. 2, 2021

(86) PCT No.: PCT/US2021/044209
§ 371 (c)(1),
(2) Date: Jan. 30, 2023

(87) PCT Pub. No.: WO2022/031612
PCT Pub. Date: Feb. 10, 2022

(65) Prior Publication Data

US 2023/0270305 A1 Aug. 31, 2023

Related U.S. Application Data

(60) Provisional application No. 63/060,364, filed on Aug. 3, 2020.

(51) Int. Cl.
*A47L 9/28* (2006.01)
*A47L 5/30* (2006.01)
(Continued)

(52) U.S. Cl.
CPC ..... *A47L 9/2805* (2013.01); *A47L 5/30* (2013.01); *A47L 7/0023* (2013.01);
(Continued)

(58) Field of Classification Search
None
See application file for complete search history.

(56) References Cited

U.S. PATENT DOCUMENTS 1,380,163 A 5/1921 Spielman
2,148,656 A 2/1939 Smellie
(Continued)

FOREIGN PATENT DOCUMENTS

AU 2003200702 A1 5/2003
CN 107710593 A 2/2018
(Continued)

OTHER PUBLICATIONS

International Search Report and Written Opinion for Application No. PCT/US2021/044209 dated Nov. 9, 2021 (14 pages).
(Continued)

*Primary Examiner* — Kaj K Olsen
*Assistant Examiner* — Pradhuman Parihar
(74) *Attorney, Agent, or Firm* — Michael Best & Friedrich LLP

(57) ABSTRACT

The present disclosure relates to a battery powered floor cleaner (10). The floor cleaner (10) is operable in various modes based on the capacity of a battery pack (22), such as a normal power mode (40) and a low power mode (42).

16 Claims, 4 Drawing Sheets

(51) Int. Cl.

| | |
|---|---|
| ***A47L 7/00*** | (2006.01) |
| ***A47L 9/04*** | (2006.01) |
| ***A47L 11/30*** | (2006.01) |
| ***A47L 11/40*** | (2006.01) |

(52) U.S. Cl.

CPC ..... *A47L 9/0411* (2013.01); *A47L 9/2842* (2013.01); *A47L 9/2847* (2013.01); *A47L 9/2857* (2013.01); *A47L 9/2884* (2013.01); *A47L 11/30* (2013.01); *A47L 11/4005* (2013.01); *A47L 11/4011* (2013.01); *A47L 11/4016* (2013.01); *A47L 11/4083* (2013.01); *A47L 11/4088* (2013.01)

(56) References Cited

U.S. PATENT DOCUMENTS

| | | | | |
|---|---|---|---|---|
| 3,715,775 | A | 2/1973 | Nickelson | |
| 4,969,229 | A | 11/1990 | Svanberg et al. | |
| 5,014,388 | A | 5/1991 | Schiazza et al. | |
| 5,115,538 | A | 5/1992 | Cochran et al. | |
| 5,243,732 | A | 9/1993 | Koharagi et al. | |
| 5,255,409 | A | 10/1993 | Fujiwara et al. | |
| 5,881,430 | A | 3/1999 | Driessen et al. | |
| 6,061,869 | A | 5/2000 | Ettes et al. | |
| 6,363,571 | B1 | 4/2002 | Block et al. | |
| 6,448,732 | B1 | 9/2002 | Block | |
| 6,457,205 | B1 | 10/2002 | Conrad | |
| 6,526,622 | B2 | 3/2003 | Conrad | |
| 7,237,299 | B2 | 7/2007 | Tondra et al. | |
| 9,055,848 | B2 | 6/2015 | Liu et al. | |
| 10,512,382 | B2 | 12/2019 | Senoo et al. | |
| 2005/0005389 | A1* | 1/2005 | Rau | A47L 11/4044 15/320 |
| 2008/0047093 | A1* | 2/2008 | Gordon | A47L 11/34 15/320 |
| 2009/0271944 | A1 | 11/2009 | Lovelass | |
| 2014/0127975 | A1 | 5/2014 | Roy et al. | |
| 2014/0259514 | A1* | 9/2014 | Vail | A47L 11/408 15/322 |
| 2016/0095488 | A1* | 4/2016 | Lee | A47L 9/2884 15/319 |
| 2018/0228337 | A1 | 8/2018 | Vail et al. | |

FOREIGN PATENT DOCUMENTS

| | | | |
|---|---|---|---|
| CN | 105595916 | B | 6/2018 |
| CN | 109091087 | A | 12/2018 |
| CN | 109199251 | A | 1/2019 |
| CN | 109700378 | A | 5/2019 |
| CN | 109938643 | A | 6/2019 |
| CN | 110419987 | A | 11/2019 |
| EP | 0458057 | A1 | 11/1991 |
| EP | 3000373 | A1 | 3/2016 |
| EP | 3001940 | A1 | 4/2016 |
| EP | 3524115 | A1 | 8/2019 |
| GB | 162777 | A | 5/1921 |
| JP | H05220064 | A | 8/1993 |
| JP | H05228073 | A | 9/1993 |
| KR | 0137436 | Y1 | 2/1999 |
| WO | 2019125950 | A1 | 6/2019 |

OTHER PUBLICATIONS

Chinese Patent Office Action for Application No. 202180064725.5 dated Dec. 29, 2025 (23 pages including English translation).

Examination Report No. 1 issued by the Australian Patent Office for Application No. 2021320642 dated Apr. 9, 2026 (4 pages).

* cited by examiner

FLOOR CLEANER WITH A LOW POWER MODE

CROSS-REFERENCE TO RELATED APPLICATIONS

This application claims priority to U.S. Provisional Patent Application No. 63/060,364, filed Aug. 3, 2020, the entire contents of which are hereby incorporated by reference herein.

SUMMARY

The present invention relates to a floor cleaner with a base, a handle, a suction source, a liquid distribution system, a recovery tank, and a battery pack. The base includes a suction inlet. The handle is coupled to the base, and the base is movable along a surface to be cleaned by a user manipulating the handle. The suction source is configured to generate an airflow through the suction inlet. The liquid distribution system includes a supply tank connected to a fluid distributor that is configured to deliver solution to the surface. The recovery tank is in fluid communication with the suction source and configured to store the solution drawn through the suction inlet from the surface to be cleaned by the suction source. The battery pack is configured to supply power to the suction source and the liquid distribution system. A sensor is configured to sense a characteristic of the battery pack indicative of a remaining capacity of the battery pack. The characteristic is selected from a group consisting of current, voltage, and power. A controller is operatively connected to the battery pack, the suction source, and the fluid distributor. The controller includes an electronic processor and a memory. The controller is configured to receive from the sensor the characteristic of the battery pack indicative of remaining capacity of the battery pack, operate the floor cleaner in a first mode when the remaining capacity of the battery pack is greater than a first threshold, operate the floor cleaner in a second mode when the remaining capacity of the battery pack is greater than a second threshold and less than the first threshold, and interrupt operation of the floor cleaner when the remaining capacity of the battery pack is less than the second threshold.

In another embodiment, a method of operating a floor cleaner is disclosed. The method includes supplying power to the floor cleaner from a battery pack, distributing fluid from a liquid distribution system onto a surface to be cleaned, recovering the fluid into a recovery tank in fluid communication with a suction source through a suction inlet, and measuring a remaining capacity of the battery pack. The method further comprises communicating the measured remaining capacity with a controller, comparing the measured remaining capacity with a first threshold value stored by the controller, operating at least one of the suction source and the liquid distribution system in a first mode when the measured remaining capacity is greater than the first threshold value, operating at least one of the suction source and the liquid distribution system in a second mode when the measured remaining capacity is less than the first threshold value and greater than a second threshold value, and interrupting operation of the floor cleaner when the remaining capacity of the battery pack is less than the second threshold value.

DETAILED DESCRIPTION

Battery operated floor cleaners, such as extractors, may be operated without being plugged into a wall outlet and thus are more portable and convenient. Typically, battery powered devices have a fixed operating duration based on the charge of the batteries. In some surface cleaning methods, a user may distribute cleaning solution to the surface to be cleaned, and subsequently vacuum the cleaning solution using the extractor. In one embodiment, the battery powered extractor detects when the battery is low, and enters a second mode, or low power mode, to extend the extractor run time on the remaining charge of the battery.

Figure 1:
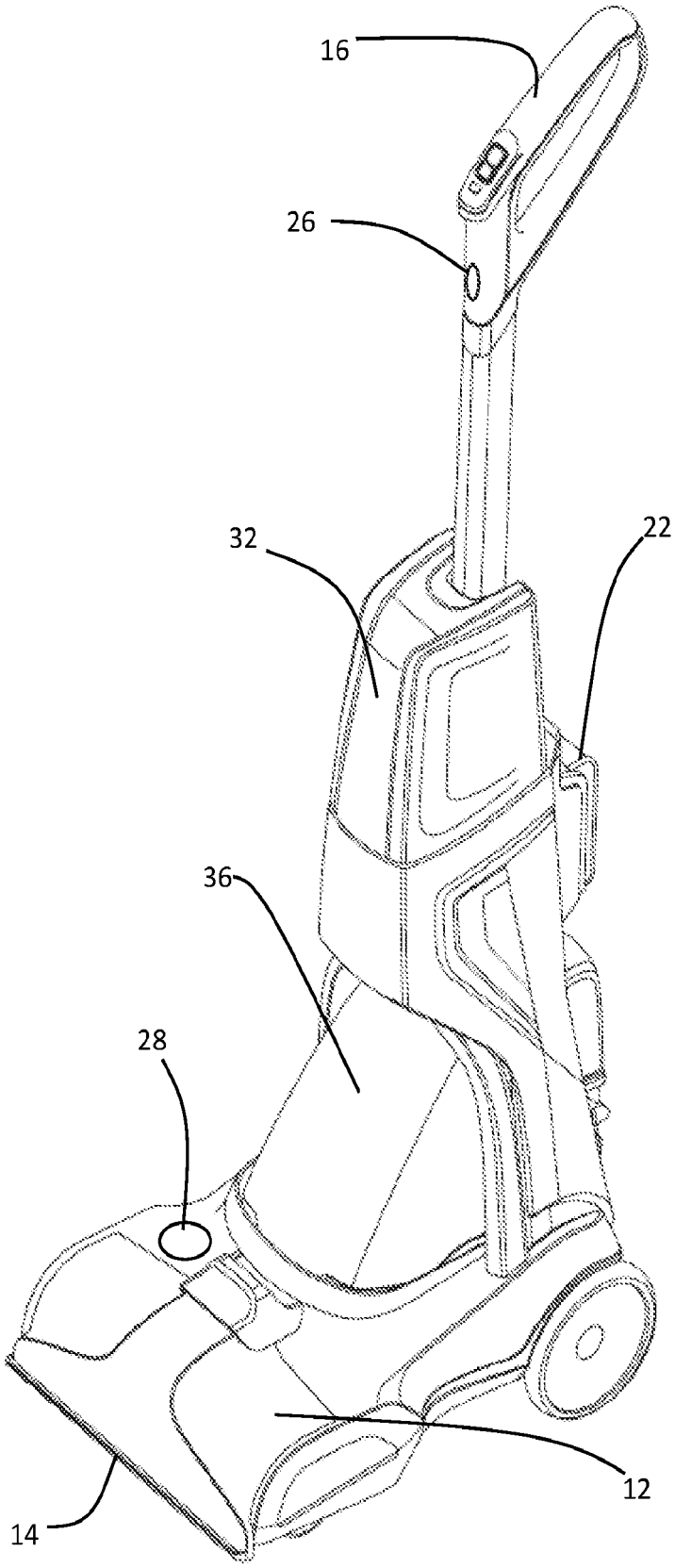
FIG. 1 is a perspective view of a floor cleaner according to one embodiment of the invention.
Figure 4:
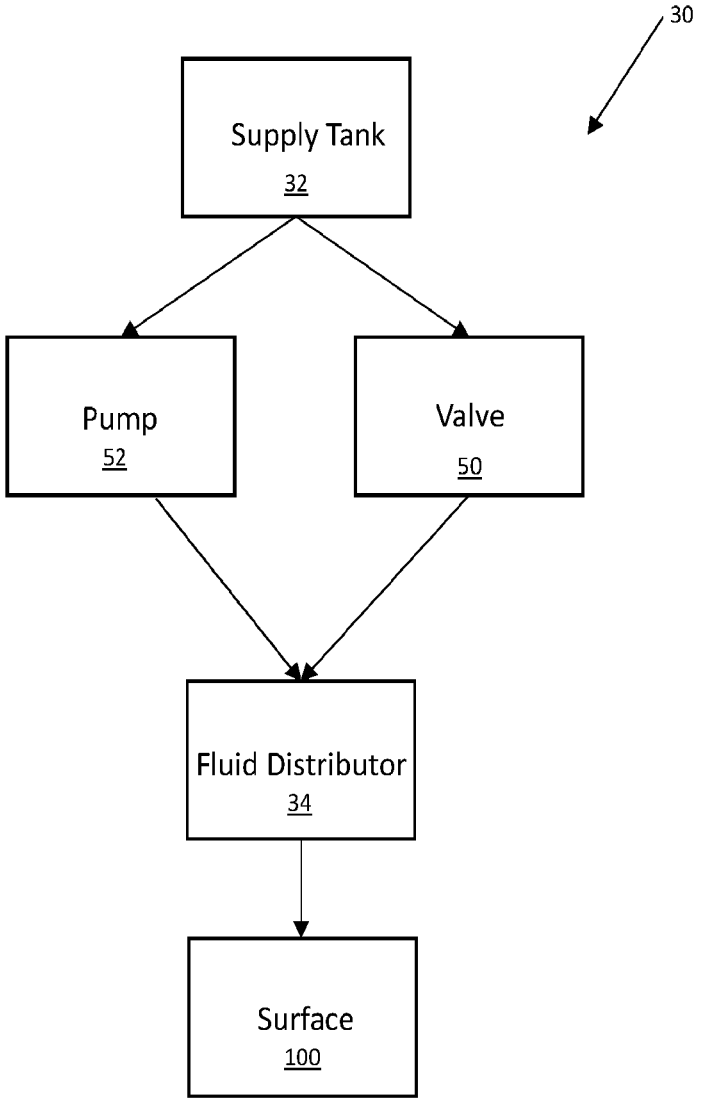
FIG. 4 is a schematic flow chart showing a liquid distribution system of the floor cleaner shown in FIG. 1.

The disclosure relates to a floor cleaner such as a vacuum cleaner, an extractor, or the like. More specifically, this disclosure relates to a battery-powered floor cleaner that includes a controller configured to monitor the remaining capacity of the battery and operate the floor cleaner in a variety of different cleaning modes based on the battery capacity. FIG. 1 illustrates a floor cleaner 10. The floor cleaner 10 includes a base 12 having a suction inlet 14, a handle 16 coupled to the base 12, a suction source 20 (FIG. 2), a liquid distribution system 30 (FIG. 4), a recovery tank 36, and a battery pack 22 that powers the suction source 20 and a fluid distributor 34 of the liquid distribution system 30.

The handle 16 of the floor cleaner 10 is coupled to the base 12 and the base 12 is moveable along a surface to be cleaned 100 by a user manipulating the handle 16. The liquid distribution system 30, shown schematically in FIG. 4, includes a supply tank 32 connected to the fluid distributor 34. The fluid distributor 34 is configured to deliver solution to the surface to be cleaned 100. In one embodiment, shown schematically in FIG. 4, the fluid distributor 34 includes a valve 50 that is moveable between an open position to allow fluid flow to the surface to be cleaned 100, and a closed position to inhibit fluid flow to the surface to be cleaned 100. In one embodiment, the fluid distributor 34 includes a pump 52 that is operable to allow fluid flow to the surface 100 in a powered on configuration, and to inhibit fluid flow to the surface 100 in a powered off configuration. The suction source 20 is configured to generate an airflow through the suction inlet 14. The recovery tank 36 is in fluid communication with the suction source 20 and is configured to store the solution drawn through the suction inlet 14 from the surface to be cleaned by the suction source 20. In one embodiment, the floor cleaner 10 includes an agitator 18 driven by an agitator motor. The agitator 18 is configured to agitate the surface to be cleaned to assist in removing dirt and debris. The agitator motor is driven by the battery pack.

Figure 2:
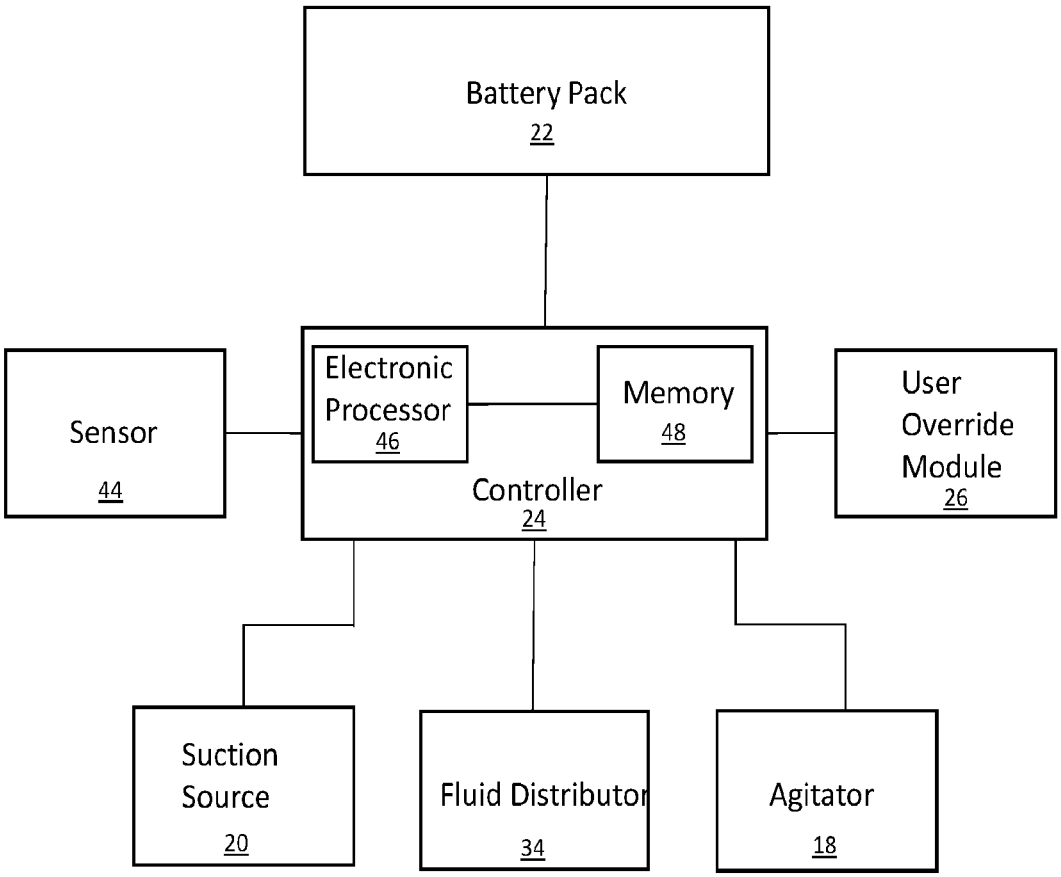
FIG. 2 is a schematic block diagram showing the flow of information of subsystems of the floor cleaner shown in FIG. 1.

FIG. 2 is a block diagram of a control system of the cleaner according to some embodiments. The control system includes a controller 24. The controller 24 is operatively connected to the battery pack 22, the suction source 20, and the fluid distributor 34. The controller 24 includes, among other things, a processing unit 46 (e.g., a microprocessor) and a memory 48. The battery pack 22 is in communication with the controller 24, and the controller 24 is in communication with the suction source 20, the fluid distributor 34, and the agitator 18. The controller 24 is configured to store battery capacity operating parameters in the memory, and is capable of adjusting or changing the operating parameters (i.e., full power mode, normal operating mode, low power mode, etc.) according to information received from the battery pack 22. The controller 24 monitors the capacity of the battery pack 22 and initiates a low power mode when the remaining battery capacity reaches a predetermined threshold. The information is based on the operating parameters stored in memory including, among other things, discharge currents, charge currents, and threshold values. The operating parameters stored in memory may vary based on battery type. The parameters may be determined empirically and preprogrammed into the controller 24.

In one embodiment, the controller 24 is configured to monitor at least one characteristic of the battery pack 22 (e.g., voltage, current, resistance, power) correlated to remaining capacity of the battery. In one embodiment, the controller 24 is in communication with a sensor 44 and the controller 24 uses the sensor to measure the characteristic of the battery pack 22. When monitoring voltage, for example, a predetermined threshold voltage is programed, that when reached, indicates low remaining battery capacity. When monitoring current, for example, the controller 24 may use a lookup table, function, formula, or other calculation to determine remaining capacity based on the measured current. Based on the controller 24 receiving the measured characteristic correlated to remaining capacity of the battery, the controller 24 is configured to adjust the operation of one or more components of the floor cleaner 10. In one embodiment, the sensor 44 is in the battery pack 22, and the battery pack is configured to sense one or more characteristics indicative of remaining capacity (e.g., voltage, current, resistance, power) and provide the measured characteristic to the controller 24. The controller 24 is configured to receive the characteristic indicative of the remaining capacity of the battery pack from the sensor 44, and adjust the operation of one or more components of the floor cleaner 10 in response to remaining capacity of the battery pack. For one example, the controller 24 controls distribution of the solution by the fluid distributor 34 based upon receiving a low battery signal from the battery 22, such as by limiting distribution of fluid in one embodiment. The controller 24 may also control the suction source 20 and the agitator 18 based on the monitored characteristic of the battery pack 22. Stated another way, the controller 24 receives a sensor output signal corresponding to the sensed characteristics from the sensor 44 indicative of remaining capacity of the battery pack 22, and provides power to the suction source 20, agitator motor, and/or the fluid distributor 34 based on the sensor output signal relative to the remaining battery capacity. In one embodiment, the controller 24 continues to monitor the characteristic correlated to remaining capacity of the battery to determine when the battery is depleted, such as at a second threshold, and turns the cleaner off.

The controller 24 operates the floor cleaner 10 in a first mode 40 when the monitored characteristic correlated to remaining capacity of the battery pack 22 is greater than a first predetermined threshold. The first threshold is selected to divide the operating capacity of a charged battery into two portions, the portion above the first threshold desirable for operating the cleaner in the first or normal mode, and the capacity below the first threshold representing low- or lower-capacity during which a second or low power mode may be desirable. The first mode 40 may also be referred to as a normal operating mode, where all the components of the floor cleaner 10 are operating at normal power capacity and/or at normal outputs. The second mode 42 may also be referred to as a low power operating mode, during which the cleaner may, in various embodiments, prioritize certain functions for the remaining duration of the battery run time.

Figure 3:
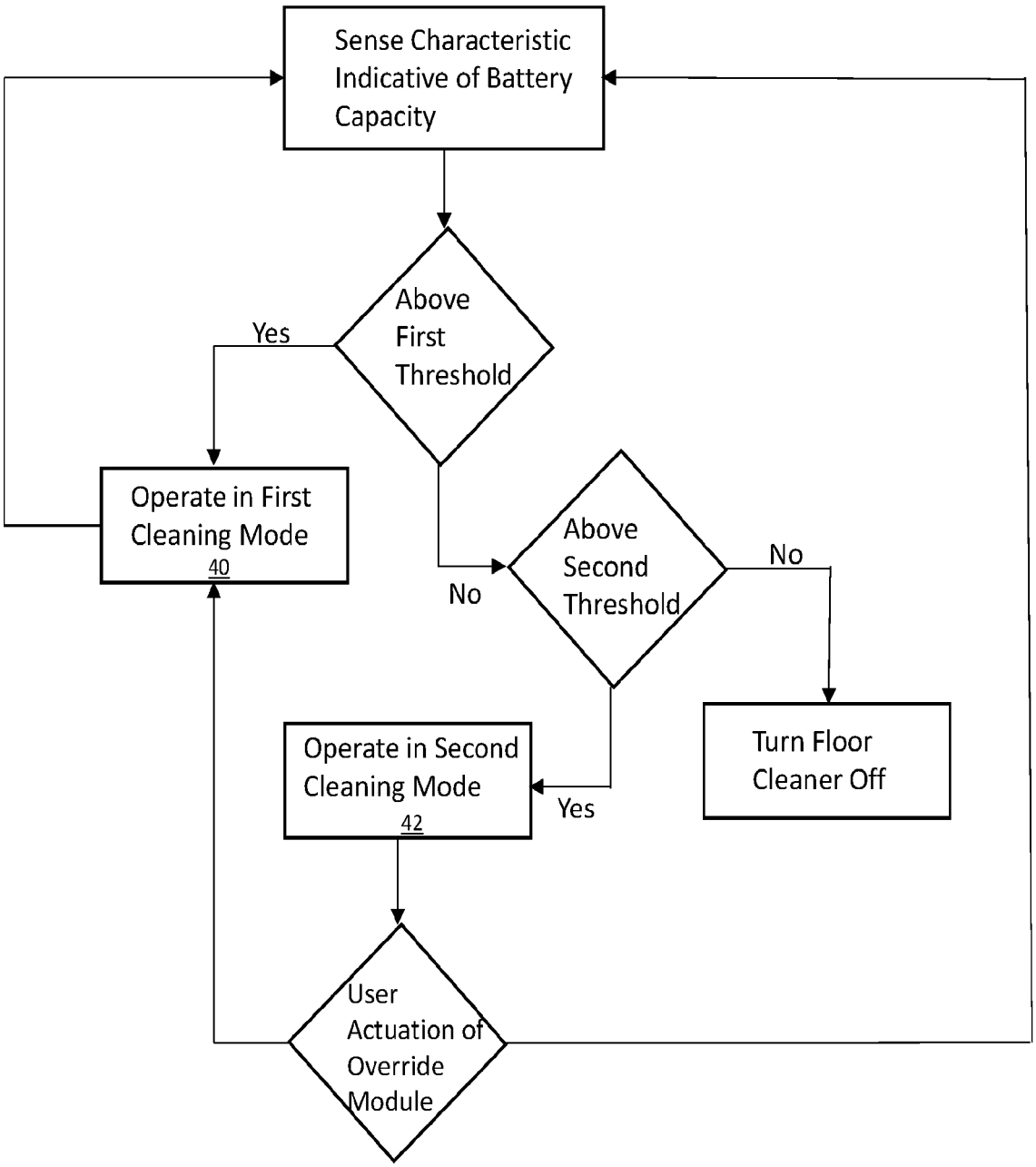
FIG. 3 is a flow chart showing different operating modes of the floor cleaner shown in FIG. 1.

The controller 24 operates the floor cleaner 10 in the second mode 42 when the monitored characteristic of the battery pack 22 is lower than the first threshold but is greater than a second predetermined threshold, which is lower than the first threshold. In the second mode 42, or low power mode, the floor cleaner 10 may operate selected components at a limited operation in order to prolong the functional operating duration of the floor cleaner 10 on the remaining battery capacity, or may limit selected functions during operation on the remaining battery capacity, or may prioritize certain functions for the remaining duration of the battery run time. In one embodiment, the output of selected components is reduced in the second mode, or low power mode. The controller 24 interrupts operation of the floor cleaner 10 when the monitored characteristic of the battery pack 22 is less than the second threshold (FIG. 3).

The first threshold may be selected such that the cleaner can operate a predetermined duration in the low power mode, such as between 1 and 15 minutes in low power mode, or between 2 and 8 minutes, or between 2 and 5 minutes in low power mode, or other duration as desired for the battery type and the application. The second threshold may be selected to be where the battery is effectively depleted, at which the cleaner is stopped.

In the first mode or normal operating mode, the controller 24 operates the components of the floor cleaner 10 upon user demand, such as the fluid distributor 34, the suction source 20, and the agitator motor. In the second mode or low power mode, the controller 24 may operate the various components at a reduced power from the battery pack 22, or may disable or limit operation of certain components. The low power mode may vary based on the floor cleaner, or user selection, or the floor surface to be cleaned.

When the controller 24 determines the capacity of the battery pack 22 is below the first threshold and above the second threshold, the controller 24 operates the cleaner in the low power mode. The low power mode may be configured to emphasize liquid recovery. For example, the controller 24 may limit the amount of fluid the user can put down in the low power mode and maximize fluid pick up. Alternatively or additionally, the low power mode may be configured to emphasize prolonging functional operating duration by reducing power to one or more components, such as the suction motor, agitator, and other components. In one embodiment of the low power mode, the controller 24 disables activation of the fluid distributor 34 to inhibit additional fluid from being distributed to the surface to be cleaned 100. In another embodiment of the low power mode, the controller 24 limits the flow rate of fluid delivered from the fluid distributor 34 to a non-zero flow rate between 0 and 50% of a maximum flow. In one embodiment, the controller 24 operates the suction source 20 at normal power and output in order to facilitate fluid uptake in the low power mode. In one embodiment, in the lower power mode the controller 24 operates the suction source 20 at increased power to prioritize pick-up. In various embodiments, in the low power mode the controller 24 modifies the power directed to the suction source 20, for example providing less than 50% power to the suction source 20, or providing between 50% and 75% power to the suction source 20, or providing between 60% and 98% power, or providing between 75% and 110% power to the suction source. In one embodiment, in the lower power mode the controller 24 operates the agitator 18 at normal power and speed in order to facilitate fluid uptake in the low power mode. In one embodiment, in the lower power mode the controller 24 operates the agitator 18 at increased power to prioritize pick-up. In various embodiments, in the low power mode the controller 24 modifies power to the agitator 18, for example providing less than 50% power to the agitator 18 in the low power mode, or providing between 50% and 75% power, or providing between 60% and 98% power, or providing between 75% and 110% power to the agitator 18 in the low power mode. In another embodiment, in the low power mode the controller 24 inhibits operation of the fluid distributor 34 and the agitator 18 and reduces the power directed to the suction source 20, for example providing between 60% and 98% power to the suction source 20. In yet another embodiment, in the low power mode the controller 24 inhibits the operation of the fluid distributor 34 and reduces the power directed to the suction source 20 and the agitator, for example providing between 60% and 98% power to the systems in the low power mode.

In one embodiment, shown in FIG. 1, the controller 24 is operatively connected to one or more light-emitting diode ("LED") indicators 28 visible to the user. In the embodiment illustrated in FIG. 1, the LED indicator 28 is shown on the base 12 of the floor cleaner 10, but in other embodiments the LED indicator maybe located somewhere else on the floor cleaner, such as on the handle 16. The LED indicator 28 provides information to the user related to the state of the battery pack 22. When the controller 24 detects the capacity of the battery pack 22 reach the first threshold, the controller 24 may indicate a low battery warning to the user via the LED indicator 28. When the controller 24 detects the capacity of the battery pack 22 reach the second threshold, the LED indicator 28 may indicate that the floor cleaner 10 is entering the low power mode. When the controller 24 detects the capacity of the battery pack 22 is below the second threshold, the LED indicator 28 may indicate a power off message to the user.

In some instances, the user may not want to use the floor cleaner 10 in the low power mode when the battery pack 22 is low, but rather would prefer cleaning in the normal operating mode. In the embodiment illustrated in FIGS. 1-3, the floor cleaner 10 includes a user override interface 26. The user override interface 26 is actuatable by the user and allows the user to manually override the low power mode, and to continue in the normal operating mode for the remaining battery capacity. In the illustrated embodiment, the user override interface 26 is a user activatable button or switch that, when activated, causes the controller 24 to enter the normal operating mode.

The floor cleaner 10 is operated by supplying power to the floor cleaner from the battery pack 22, distributing solution from the fluid distributor 34 onto the surface to be cleaned, and recovering the solution into the recovery tank 36 which is in fluid communication with the suction source 20 and the suction inlet 14. In one embodiment, the controller 24 receives or determines the remaining capacity of the battery pack 22. The remaining capacity is compared with a first threshold capacity value stored by the controller 24. The controller 24 operates the floor cleaner 10 in a first mode associated with a normal power mode when the remaining capacity is greater than the first threshold value, and a second mode associated with the low power mode when the remaining capacity is less than the first threshold value. The floor cleaner operates the suction source 20, the agitator 18, and the fluid distributor 34 at a first operating condition while in the first mode, and operates the suction source 20, the agitator 18 and the fluid distributor 34 at a second operating condition while in the second mode.

The controller 24 may be disposed in the cleaner and operatively controlling the functional components of the floor cleaner 10 and battery pack 22. Alternatively, the controller may be disposed in the battery pack 22 and operatively controlling the functional components of the floor cleaner 10 and battery pack 22. In one embodiment, the controller 24 includes two or more sub-controllers, where one sub-controller is disposed in the cleaner body operatively controlling certain functional components of the floor cleaner 10, and where a second sub-controller is disposed in the battery pack 22 operatively controlling the battery pack 22, and optionally other functional components of the floor cleaner 10. The controller 24, optionally using one or more sub-controllers, is configured to receive from the sensor the characteristic of the battery pack indicative of the remaining capacity of the battery pack, operate the floor cleaner in a first mode when the remaining capacity of the battery pack is greater than a first threshold, operate the floor cleaner in a second mode when the remaining capacity of the battery pack is greater than a second threshold and less than the first threshold, and interrupt operation of the floor cleaner when the remaining capacity of the battery pack is less than the second threshold.

In one embodiment, the floor cleaner is a dry vacuum cleaner, such as an upright vacuum, a stick vacuum, or the like. In this embodiment, there is typically no fluid distribution system. As discussed above, the controller monitors the remaining battery capacity of the battery pack. The controller operates the floor cleaner in the first mode when remaining battery capacity is greater than the first predetermined threshold, and operates the floor cleaner in the second mode when the battery capacity is lower than the first threshold but is greater than the second predetermined threshold. The second mode as discussed above, is the low power mode, and the controller operates the systems of the floor cleaner (e.g., suction source, agitator) with reduced output or prioritized functions. When the battery capacity of the floor cleaner is below the second threshold, the controller interrupts operation of the floor cleaner.

It is to be understood that the invention is not limited in its application to the details of construction and the arrangement of components set forth in the following description or illustrated in the following drawings. The invention is capable of other embodiments and of being practiced or of being carried out in various ways.

What is claimed is:

1. A floor cleaner comprising:

a base having a suction inlet;

a handle coupled to the base, the base movable along a surface to be cleaned by a user manipulating the handle;

a suction source configured to generate an airflow through the suction inlet;

a liquid distribution system including a supply tank connected to a fluid distributor configured to deliver solution to the surface;

a recovery tank in fluid communication with the suction source configured to store the solution drawn through the suction inlet from the surface to be cleaned by the suction source;

a battery pack configured to supply power to the suction source and the liquid distribution system;

a sensor configured to sense a characteristic of the battery pack indicative of a remaining capacity of the battery pack, the characteristic selected from a group consisting of-current, voltage, and power;

a controller operatively connected to the battery pack, the suction source, and the fluid distributor, the controller including an electronic processor and a memory, the controller configured to:

receive from the sensor the characteristic of the battery pack indicative of the remaining capacity of the battery pack, operate the floor cleaner in a first mode when the remaining capacity of the battery pack is greater than a first threshold, wherein in the first mode of operation the controller operates a component of the floor cleaner based on a user input, wherein the component includes a first component and a second component, operate the floor cleaner in a second mode when the remaining capacity of the battery pack is greater than a second threshold and the remaining capacity of the battery pack is less than the first threshold, wherein in the second mode the controller operates the floor cleaner based on a prioritized function of the first component, wherein in the second mode the controller continues providing power to the first component and reduces the power provided to the second component or continues providing power to the first component and inhibits a function of the second component, and interrupt operation of the floor cleaner when the remaining capacity of the battery pack is less than the second threshold.

2. The floor cleaner of claim 1, wherein the fluid distributor further comprises a pump or a valve to control fluid delivery to the surface to be cleaned.

3. The floor cleaner of claim 2, wherein the fluid distributor further comprises a valve assembly, wherein the valve assembly is closed in the second mode, inhibiting distribution of solution to the surface to be cleaned in the second mode.

4. The floor cleaner of claim 1, wherein the controller limits operation of the second component when the floor cleaner is in the second mode, wherein the second component includes at least one of the suction source and the fluid distributor.

5. The floor cleaner of claim 4, wherein the controller limits the flow rate of fluid delivered from the fluid distributor to between 0 and 50% of a maximum flow rate when the floor cleaner is in the second mode.

6. The floor cleaner of claim 4, wherein the controller limits the power supplied from the battery pack to the suction source to between 60 and 98% of full power in the second mode.

7. The floor cleaner of claim 1, further comprising an agitator in the base, the agitator powered by the battery pack and configured to agitate the surface to be cleaned during operation, wherein the controller limits the power supplied from the battery pack to the agitator.

8. The floor cleaner of claim 1, further comprising a user override module configured to change the floor cleaner from the second mode to the first mode in response to actuation by the user.

9. The floor cleaner of claim 1, wherein the controller is configured to:

compare the characteristic of the battery pack to the first threshold and the second threshold, and in response to comparing the characteristic of the battery pack to the first threshold and the second threshold, operate the floor cleaner in the second mode when the remaining capacity of the battery pack is greater than the second threshold and less than the first threshold.

10. The floor cleaner of claim 1, wherein operating in the second mode, the controller is configured to:

reduce an output of the second component by controlling operation of the second component, wherein the second component is at least one selected from the group consisting of: an agitator, the suction source, and the fluid distributor.

11. The floor cleaner of claim 1, wherein operating in the second mode, the controller configured to:

modify an output of the component by controlling the component, wherein the component includes at least two component selected from the group consisting of: an agitator, the suction source, and the fluid distributor, wherein the output of the component operated in the second mode is different from the output of the component operated in the first mode.

12. The floor cleaner of claim 1, wherein the first mode includes a first mode of operation for the floor cleaner and the second mode includes a second mode of operation, and wherein the first mode of operation is different from the second mode of operation.

13. The floor cleaner of claim 1, wherein the controller is configured to operate the fluid distributor to deliver solution at a first flow rate in the first mode and a second flow rate in the second mode, wherein the second flow rate is less than the first flow rate.

14. The floor cleaner of claim 1, wherein the controller is configured to supply a first power to the suction source in the first mode and a second power to the suction source in the second mode, the first power different from the second power.

15. The floor cleaner of claim 14, wherein the second power is greater than the first power.

16. The floor cleaner of claim 14, wherein the second power is less than the first power.

* * * * *